US006527145B1

(12) United States Patent
Bennett, Jr.

(10) Patent No.: US 6,527,145 B1
(45) Date of Patent: Mar. 4, 2003

(54) BEVERAGE DISPENSER

(76) Inventor: Jules G. Bennett, Jr., 640 Bailey Rd., El Paso, TX (US) 79932

( * ) Notice: Subject to any disclaimer, the term of this patent is extended or adjusted under 35 U.S.C. 154(b) by 0 days.

(21) Appl. No.: 09/962,223

(22) Filed: Sep. 26, 2001

(51) Int. Cl.[7] ..... B67D 5/06
(52) U.S. Cl. ..... 222/185.1; 222/325
(58) Field of Search ..... 222/83.5, 88, 89, 222/181, 181.1, 181.2, 181.3, 185.1, 481.5, 325; 285/12, 148.18, 148.28, 333, 355

(56) References Cited

U.S. PATENT DOCUMENTS

| | | | | | |
|---|---|---|---|---|---|
| 2,887,252 | A | | 5/1959 | Nelsen | |
| 3,053,419 | A | | 9/1962 | Palmer | |
| 4,067,072 | A | * | 1/1978 | Izzi | 285/12 |
| 4,386,718 | A | * | 6/1983 | Stewart et al. | 222/185.1 |
| 5,104,003 | A | | 4/1992 | Stecoza | |
| 5,330,080 | A | | 7/1994 | O'Connor | |
| 5,405,058 | A | | 4/1995 | Kelis et al. | |
| 5,472,025 | A | * | 12/1995 | Conrad et al. | 285/12 |
| 5,509,583 | A | | 4/1996 | Dolson | |
| 5,647,416 | A | * | 7/1997 | Desrosiers et al. | 222/181.1 |
| 5,826,755 | A | | 10/1998 | Burd | |
| 5,848,736 | A | * | 12/1998 | Boumann | 222/185.1 |
| 6,161,726 | A | * | 12/2000 | Parsons et al. | 222/181.3 |
| 6,193,113 | B1 | * | 2/2001 | Hidding | 222/83.5 |

* cited by examiner

*Primary Examiner*—Gene Mancene
*Assistant Examiner*—Melvin A. Cantagena
(74) *Attorney, Agent, or Firm*—Shlesinger, Arkwright & Garvey LLP

(57) ABSTRACT

A beverage dispenser comprises a support structure; a first tube secured to the support structure; a connector secured to one end of the first tube, the connector having an opening therethrough so as to be in communication with the first tube; and a valve secured to another end of the tube. The connector is secured to a beverage container so that the opening is in communication with the interior of the beverage container to allow the beverage to flow through the first tube and through an open valve. The connector includes first and second inside threads to selectively connect to outside threads of a respective smaller or larger beverage container.

20 Claims, 5 Drawing Sheets

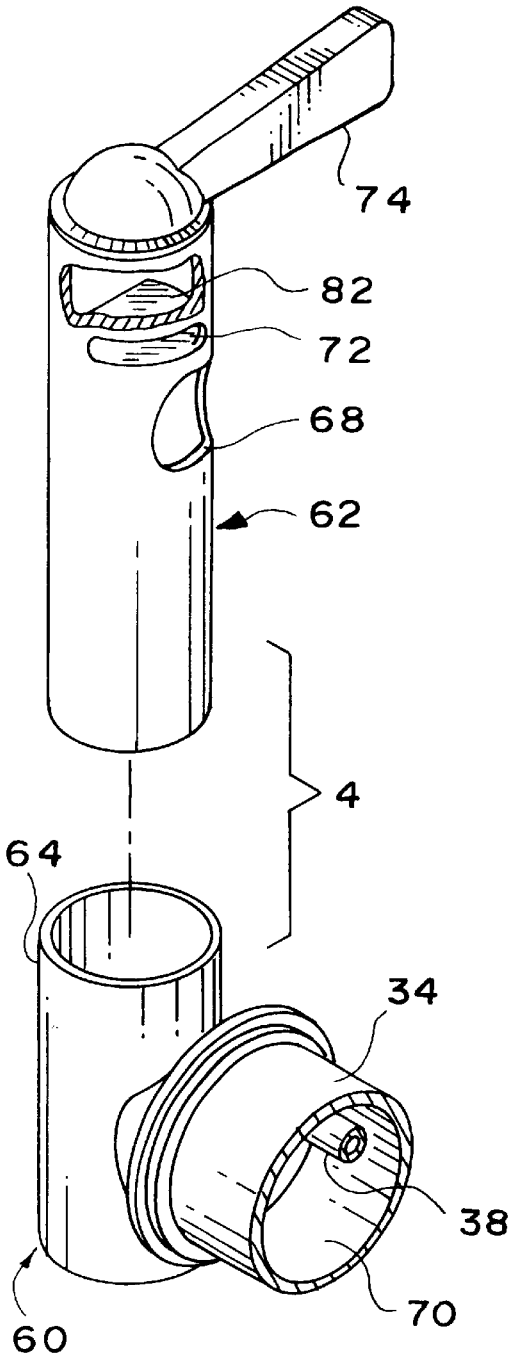
FIG. 7
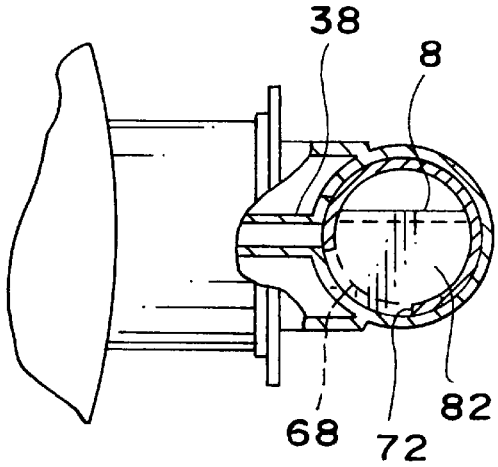
FIG. 8
FIG. 9
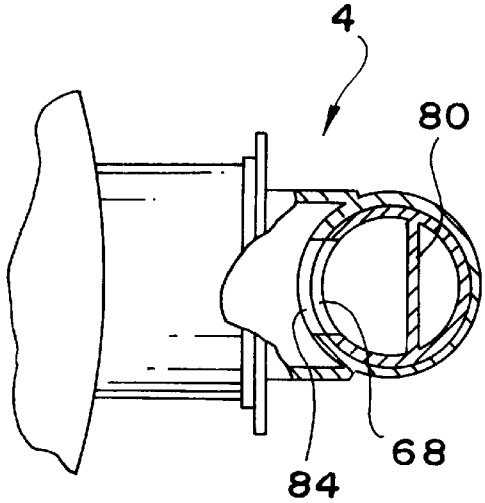

BEVERAGE DISPENSER

FIELD OF THE INVENTION

The present invention relates to a beverage dispenser in general and in particular to a beverage dispenser to which a beverage container attaches and where the beverage container may come in one or two capacities.

BACKGROUND OF THE INVENTION

Soft drink beverages come in different size containers, such two-liter or three-liter bottles. The beverage is typically dispensed by opening the mouth of the container and pouring an amount into a cup. When children help themselves, it is sometimes unavoidable that spillage would occur, due to the weight of the container and the clumsiness of the children. Sometimes, too, children fail to close the cap bottle, which would cause the beverage to go flat over time due to escaping gas. There is, therefore, a need for a beverage dispenser that would be easy to use, particularly by children.

Each size container would have different size openings. Consequently, a dispenser designed for one bottle may not work with another bottle. Accordingly, there is a need for a beverage dispenser that can accommodate two different size bottles without the need for multiple dispensers.

OBJECTS AND SUMMARY OF THE INVENTION

It is an object of the present invention to provide a beverage dispenser that is easy and convenient to use, particularly by children.

It is another object of the present invention to provide a beverage dispenser that can accommodate different size bottles.

It is another object of the present invention to provide a beverage dispenser that keeps the gas from escaping when not dispensing.

In summary, the present invention provides a beverage dispenser, comprising a support structure; a first tube secured to the support structure; a connector secured to one end of the first tube, the connector having an opening therethrough so as to be in communication with the first tube; and a valve secured to another end of the tube. The connector is secured to a beverage container so that the opening is in communication with the interior of the beverage container to allow the beverage to flow through the first tube and through an open valve. The connector includes first and second inside threads to selectively connect to outside threads of a respective smaller or larger beverage container.

These and other objects of the present invention will become apparent from the following detailed description.

BRIEF DESCRIPTIONS OF THE DRAWINGS

FIG. 7 is a perspective assembly view of a valve used in the present invention.

FIG. 8 is a cross-sectional view taken along line 8—8 in FIG. 2, showing the valve in the closed position.

FIG. 9 is a cross-sectional view taken along line 9—9 in FIG. 2, showing the valve in the open position.

DETAILED DESCRIPTION OF THE INVENTION

Figure 1:
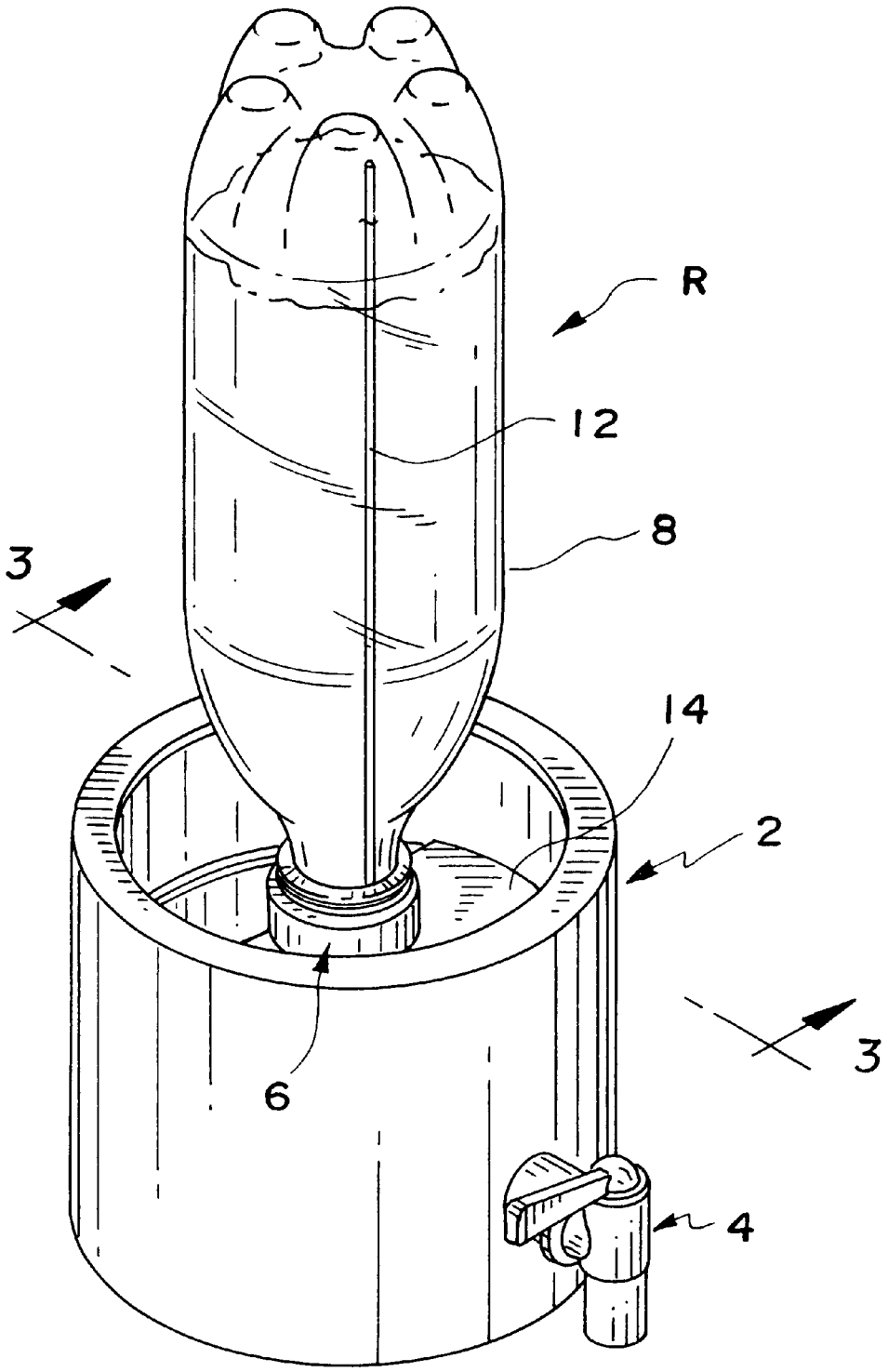
FIG. 1 is a perspective view of a beverage dispensed made in accordance with the present invention.

A beverage dispenser R made in accordance with the present invention is disclosed in FIG. 1. The dispenser R includes a support structure 2, a valve 4 and a connector 6 for connecting the dispenser to a beverage container 8. Although the beverage dispenser R is disclosed for use in dispensing beverages such as soda, it can be used for dispensing any liquids, such as bottled water, juices, etc.

Figure 2:
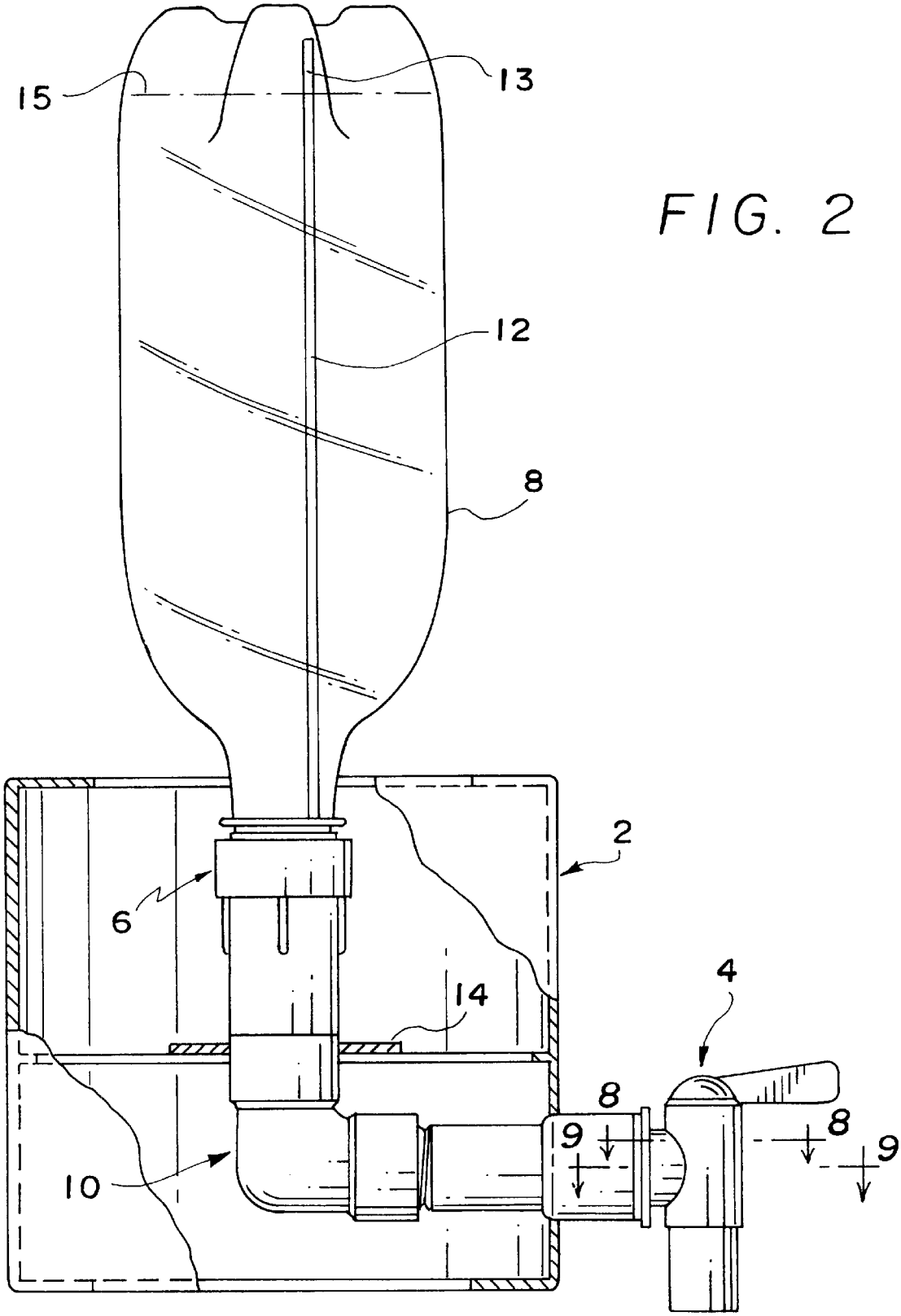
FIG. 2 is a side elevational view of FIG. 1, with portions shown in cross-section.

Referring to FIG. 2, a tube 10 conveys the liquid within the container 8 to the valve 4 for dispensing. An air bleed tube 12 provides the means for equalizing pressure within the container 8 with respect to the outside when the beverage is dispensed. A free end 13 of the tube 12 is advantageously disposed above the liquid level 15 to allow air within the container to communicate with the outside air when the valve 4 is open. When the valve 4 is closed, the tube 12 is closed to the outside, thereby keeping the beverage gas from escaping which if allowed to happen can make the beverage taste flat over time.

The support structure 2 may be in any shape sufficient to support the container 8 in an upright inverted position or any position to allow the beverage to drain to the tube 12. The support structure 2 provides the means for supporting the tube 10 and the beverage container 8. An exemplary cylindrical shell is disclosed with an intermediate cross member 14 operably secured to an upright portion 16 of the tube 10. An opening 18 at the side wall of the support structure 2 is provided to allow a horizontal portion 20 of the tube 10 to extend through. A 90° elbow 22 connects the vertical horizontal portions 16 and 20 of the tube 10. The support structure 2 has an opening 24 at the top and an opening 26 at the bottom. The opening 24 is large enough to accommodate containers wider than the typical soda bottles.

As described above, the tube 10 is disclosed as having three components joined together with cooperating threads 28 at the elbow 22. However, a person of ordinary skill in the art should understand that the tube 10 may be made in various ways, such as being molded in one piece or being made from flexible tubing without the elbow 22. It should also be understood that the tube 10 provides the means for conveying the beverage from the container 8 to the valve 4.

The top most end of the vertical portion 16 has inside threads 30 adapted to receive cooperating threads in the connector 6, thereby securing the connector 6 to the tube 10. The outermost end of the horizontal portion 20 has an enlarged portion 32 adapted to receive and be secured to a coupling portion 34 of the valve 4 by standard means such as by glueing, screw threads, etc. A seal 36 provides a liquid-tight connection. The valve 4 also has a coupling tube 38 that couples to an end portion of the bleed tube 12 in a friction fit manner or other standard means.

Figure 4:
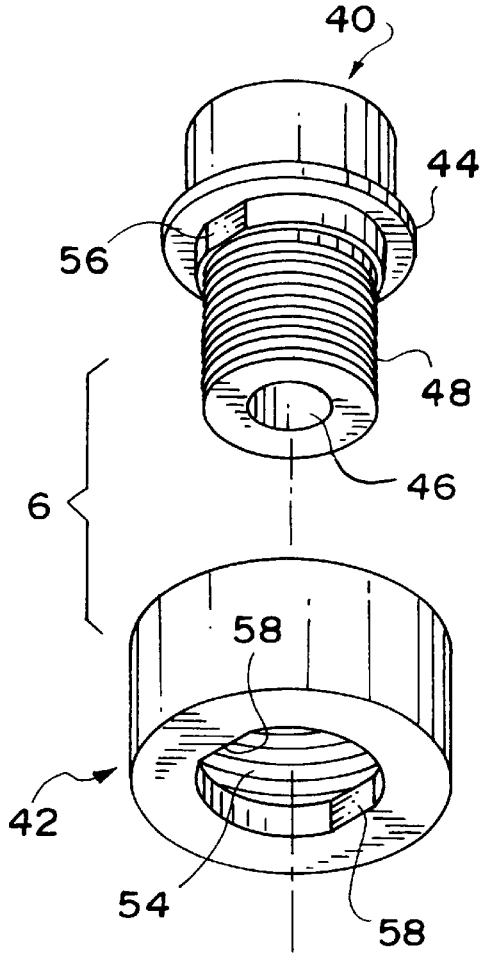
FIG. 4 is an assembly view of a connector made in accordance with the present invention.

Referring to FIG. 4, the connector 6 is a two-part system comprising a body 40 that mates to another body 42.

Figure 3:
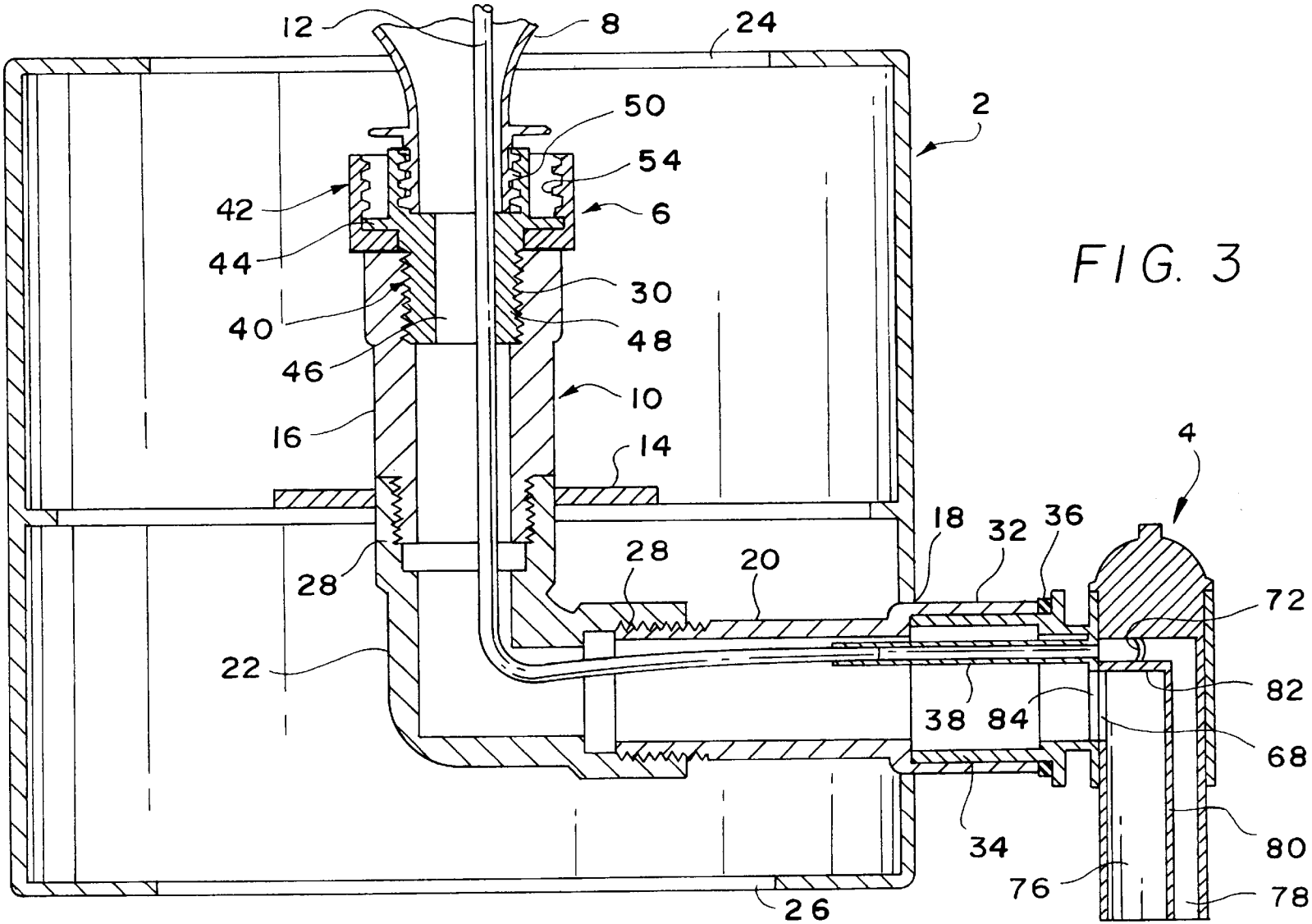
FIG. 3 is a cross-sectional view along line 3—3 in FIG. 1.

Referring back to FIG. 3, the body 40 is substantially cylindrical in shape with an intermediate outwardly projecting radial flange 44. The body 40 has a through-opening 46 that communicates with the tube 10 and with the interior of the container 8, as best shown in FIG. 3. The body 40 has outside threads 48 that mate with the inside threads 30 of the tube 10 to thereby secure the body 40 to the tube 10. Other standard means may be used to secure the body 40 to the tube 10. The body 40 further includes inside threads 50 that mate with the corresponding outside threads at the neck of the container 8.

Figure 5:
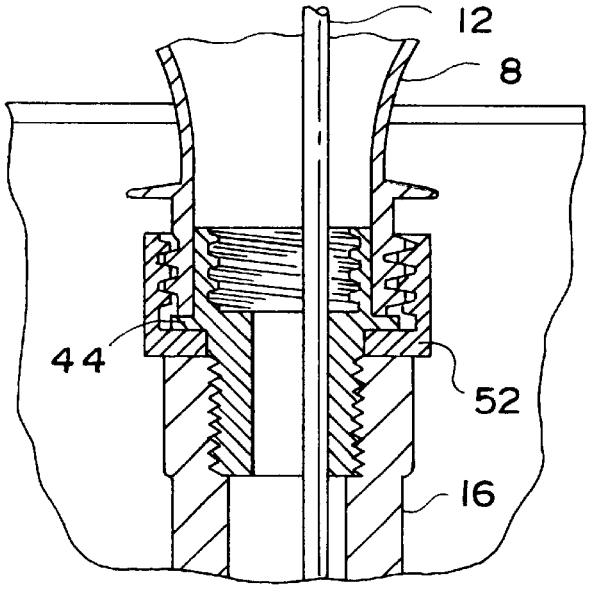
FIG. 5 is an enlarged cross-sectional view showing attachment of a larger bottle to the connector.

The body 42 is a sleeve-like structure with an inwardly projecting radial flange 52 adapted to receive and support the radial flange 44 of the body 40. The body 42 has inner threads 54 that are adapted to cooperate with the corresponding outer threads at the neck of a larger container 8, as best shown in FIG. 5. When secured to the tube 10, the flange 52 is sandwiched between an upper edge of the upright portion 16 and the flange 44, as best shown in FIGS. 3 and 4.

Figure 6:
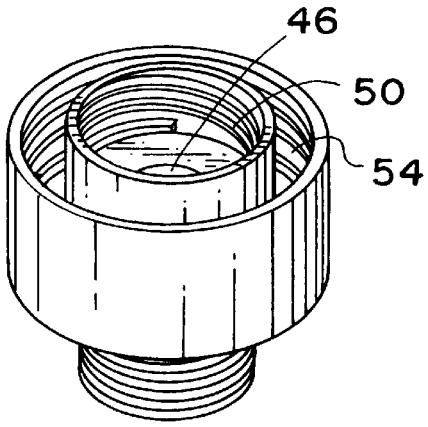
FIG. 6 is a perspective view of the connector of FIG. 4 shown assembled together.

The body 40 is keyed to the body 42 by means of corresponding planar surfaces 56 and 58 to advantageously prevent rotation of the body 42 with respect to the body 40 while screwing or unscrewing the container 8 to the inner threads 54. The bodies 40 and 42 are mated together, as shown in FIG. 6. Note the opening 46 that communicates with the interior of the container 8 and the tube 10. Also note the inner threads 50 and 54 that are configured to mate with the outer threads on the neck of the bottle 8. The inner threads 50 and 54 are preferably concentric when the bodies 40 and 42 are mated together.

The inner threads 50 or 54 provide the means for selectively connecting the dispenser R to the outside threads of a respective smaller or larger beverage container without the need for multiple dispensers for different size containers.

Referring to FIG. 7, the valve 4 includes a housing 60 and a valve member 62. The housing 60 includes a valve seat portion 64 and the coupling portion 34.

The valve member 62 is a cylindrical sleeve that fits in a rotating manner within the valve seat 64. The valve member 62 includes an opening 68 that communicates with an opening 70 of the coupling portion 34 when in the open position. The valve member 62 further includes an opening 72 that communicates with the bleed tube 12 when in the open position. A handle 74 is secured to the valve member 62 to allow the user to operate the valve member 62 in the open or closed position.

Referring to FIG. 3, the valve member 62 is divided into a first passageway 76 that communicates with the tube 10 and another passageway 78 that communicates with the bleed tube 12. A vertical divider wall 80 with a top horizontal wall 82 divides the passageways 76 and 78 from each other.

Referring to FIG. 8, the valve 4 in the closed position blocks off the opening to the bleed tube 12 and to the tube 10. The openings 68 and 72 are displaced circumferentially so that they are not in communication with tube 10 and the bleed tube 12 at the same time, respectively. As the valve member 62 is turned clockwise, with reference to FIG. 8, the opening 72 connects with the bleed tube connector 38 first before the opening 68 connects with the tube 10. In this manner, any pressure differential between the interior of the container 8 and the outside is first equalized before any beverage starts flowing through the valve. This would prevent any uneven or abrupt discharge of the liquid during the initial dispensing due to any pressure differential between the air pocket within the container and the outside.

Figure 10:
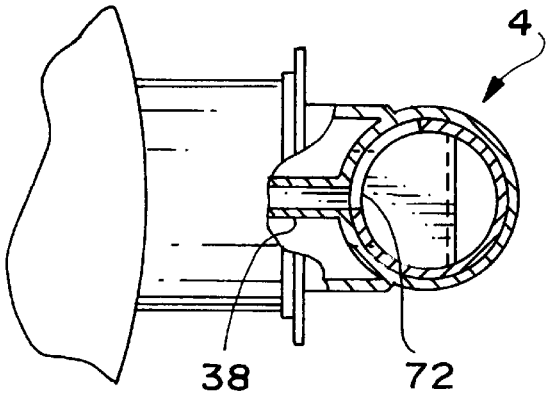
FIG. 10 is a cross-sectional view similar to FIG. 8, showing the valve in the open position.

Referring to FIGS. 9 and 10, the valve 4 in the open position shows that the opening 68 is in communication with another opening 84.in the housing 60 that communicates with the tube 10. Similarly, the opening 72 is in communication with the tube 38 that connects to the bleed tube 12.

The various components of the dispenser R may be made from plastic or suitable material. Although the beverage dispenser R is disclosed as having several components that are joined together, the various components may be molded in one piece. For example, the support structure 2, the tube 10 and the connector 6 may be molded in one piece. In this manner, various joint means, such as the threads 28 and 30 may be eliminated.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A beverage dispenser, comprising:

a) a support structure;

b) a first tube operatively secured to said support structure;

c) a connector operatively secured to one end of said first tube;

d) said connector having an opening therethrough so as to be in communication with said first tube;

e) a valve operatively secured to another end of said tube;

f) said connector for being secured to a beverage container so that said opening is in communication with the interior of the beverage container to allow the beverage to flow through said first tube and through said valve when said valve is open;

g) said connector including first and second inside threads to selectively connect to outside threads of a respective smaller or larger beverage container;

i) said another end of said first tube including an enlarged portion; and j) said valve including a coupling portion received within said enlarged portion.

2. A beverage dispenser, comprising:

a) a support structure;

b) a first tube operatively secured to said support structure;

c) a connector operatively secured to one end of said first tube;

d) said connector having an opening therethrough so as to be in communication with said first tube;

e) a valve operatively secured to another end of said tube;

f) said connector for being secured to a beverage container so that said opening is in communication with the interior of the beverage container to allow the beverage to flow through said first tube and through said valve when said valve is open;

g) said connector including first and second inside threads to selectively connect to outside threads of a respective smaller or larger beverage container;

h) a bleed tube disposed within said first tube having one end operably communicating to the outside and another end disposed beyond said connector so as to be disposed above the liquid level within the container when the container is secured to said connector;

i) said valve including an air passageway selectively in communication with said bleed tube; and j) said valve including a liquid passageway selectively in communication with said first tube.

3. A beverage dispenser as in claim 2, wherein:

a) said support structure includes a cylindrical wall.

4. A beverage dispenser as in claim 3, wherein:

a) said support structure includes a member secured to said cylindrical wall; and b) said first tube is supported by said member.

5. A beverage dispenser as in claim 2, wherein:

a) said support structure includes an opening through said cylindrical wall; and b) said first tube extends through said opening.

6. A beverage dispenser as in claim 2, wherein:

a) said first tube includes a 90° elbow.

7. A beverage dispenser as in claim 6, wherein:

a) said first tube includes a vertical portion and a horizontal portion; and b) said elbow is secured between said vertical portion and said horizontal portion.

8. A beverage dispenser as in claim 7, wherein:

a) said elbow is threadedly secured to said vertical portion and said horizontal portion.

9. A beverage dispenser as in claim 2, wherein:

a) said one end of said first tube is threadedly secured to said connector.

10. A beverage dispenser as in claim 2, wherein:

a) said another end of said first tube includes an enlarged portion; and b) said valve includes a coupling portion received within said enlarged portion.

11. A beverage dispenser as in claim 2, wherein:

a) said valve includes a housing and a shut-off member operatively disposed within said housing;

b) said housing includes an opening in communication with said first tube and said liquid passageway when said valve is in an open position; and c) said housing includes a coupling tube connected to said bleed tube and in communication with said air passageway when said valve is in an open position.

12. A beverage dispenser as in claim 11, wherein:

a) said shut-off member includes a first opening selectively in communication with said opening of said housing when said valve is in an open position; and b) said shut-off member includes a second opening selectively in communication with said coupling tube of said housing when said valve is in an open position.

13. A beverage dispenser as in claim 12, wherein:

a) said first opening is circumferentially offset from said second opening.

14. A beverage dispenser as in claim 2, wherein:

a) said first and second inside threads are concentric.

15. A beverage dispenser as in claim 2, wherein:

a) said connector includes outside threads; and b) said first tube includes inside threads cooperating with said outside threads.

16. A beverage dispenser as in claim 15, wherein:

a) said connector includes first and second bodies;

b) said first body includes said first inside threads and said outside threads of said connector; and c) said second body includes said second inside threads.

17. A beverage dispenser as in claim 2, wherein:

a) said connector includes first and second bodies;

b) said first body is substantially cylindrical and includes an outwardly projecting radial flange disposed intermediate said first body; and c) said second body includes an inwardly projecting radial flange for engaging said outwardly projecting radial flange.

18. A beverage dispenser as in claim 17, wherein:

a) said first and second bodies are keyed to each other such relative rotation between said bodies is prevented.

19. A beverage dispenser as in claim 17, wherein:

a) said first body includes a portion disposed within an opening of said second body; and b) said first body includes a flat surface engaging a corresponding flat surface on said opening.

20. A beverage dispenser, comprising:

a) a support structure;

b) a tube operatively secured to said support structure;

c) a connector operatively secured to one end of said tube;

d) said connector having an opening therethrough so as to be in communication with said tube;

e) a valve operatively secured to another end of said tube;

f) said connector for being secured to a beverage container so that said opening is in communication with the interior of the beverage container to allow the beverage to flow through said tube and through said valve when said valve is open;

g) said connector including first and second inside threads to selectively connect to outside threads of a respective smaller or larger beverage container;

h) said tube including a 90° elbow;

i) said tube including a vertical portion and a horizontal portion;

j) said elbow is secured between said vertical portion and said horizontal portion; and k) said elbow is threadedly secured to said vertical portion and said horizontal portion.

* * * * *